United States Patent [19]

Forciea

[11] 4,206,878

[45] Jun. 10, 1980

[54] BENEFICIATION OF IRON ORE

[75] Inventor: James E. Forciea, Coleraine, Minn.

[73] Assignee: United States Steel Corporation, Pittsburgh, Pa.

[21] Appl. No.: 572,601

[22] Filed: Apr. 28, 1975

[51] Int. Cl.[2] ..... B02C 23/22

[52] U.S. Cl. ..... 241/20; 75/2; 209/5; 209/8; 209/166; 209/214; 241/24

[58] Field of Search ..... 75/1, 2; 209/39, 166, 209/214, 8, 5; 241/14, 20, 24; 423/340, 150, 138

[56] References Cited

U.S. PATENT DOCUMENTS

| | | | |
|---|---|---|---|
| 2,388,471 | 11/1945 | DeVaney | 209/39 |
| 2,428,228 | 9/1947 | Keck | 209/39 |
| 2,669,355 | 2/1954 | Archibald | 209/166 |
| 3,337,328 | 8/1967 | Lawver | 75/3 |
| 3,502,271 | 3/1970 | Hays | 241/20 |

*Primary Examiner*—L. Dewayne Rutledge
*Assistant Examiner*—Michael L. Lewis
*Attorney, Agent, or Firm*—William L. Krayer

[57] ABSTRACT

Iron ore is beneficiated using separation steps based on mineral composition without the use of separation steps based entirely on size. In a preferred sequence of steps the iron ore is passed from a ball mill through a magnetic separator where low iron content tailings are rejected and the concentrate passed to a flotation step, where a high iron content concentrate froth is made and the locked, middling particles are recirculated to the ball mill.

3 Claims, 1 Drawing Figure

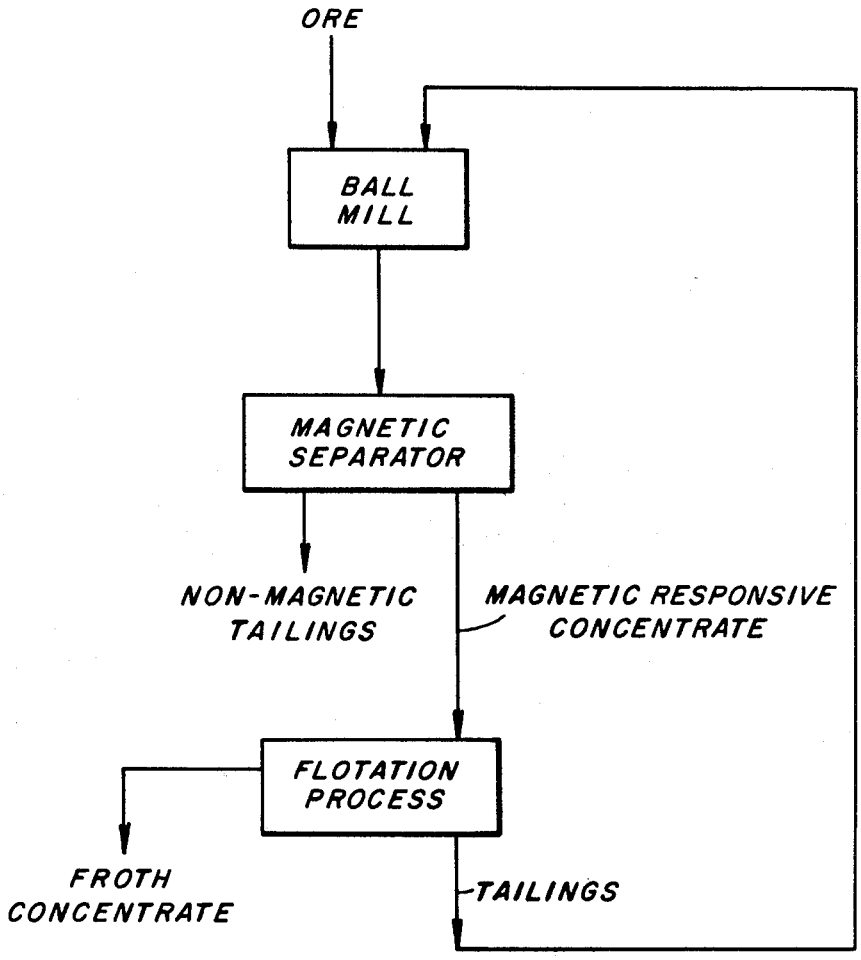
ORE
BALL MILL
MAGNETIC SEPARATOR
NON-MAGNETIC TAILINGS
MAGNETIC RESPONSIVE CONCENTRATE
FLOTATION PROCESS
FROTH CONCENTRATE
TAILINGS

BENEFICIATION OF IRON ORE

BACKGROUND OF THE INVENTION

The beneficiation of ore, particularly iron ore, conventionally has involved the use of various combinations of process setps such as crushing, grinding or milling, concentration or separation by size or weight such as by a screen and/or specific gravity, as by a hydraulic classifier, and concentration with the aid of flotation agents, as in froth flotation, or by means of a magnetic classifier. See, for example, Lawver, U.S. Pat. Nos. 3,337,328, Braund, 2,468,586, Keck, 2,428,228, Hubler, 2,352,324, Ferris, 2,336,854, Rakowsky et al, 2,325,149, Wade, U.S. Pat. No. Re. 22,191, Weed, U.S. Pat. Nos. 2,014,405 and DeVaney, 2,388,471.

For purposes of reviewing my disclosure the reader may be interested in the details of the last mentioned patent to DeVaney, wherein it may be seen that the ore is ground and crushed, sized by a classifier in a closed loop, and concentrated in a magnetic separator, the concentrate therefrom being further concentrated in a flotation circuit where the high iron content "underflow" is retained as product and the "siliceous froth", still containing significant amounts of iron, is recycled to a ball mill (which must be set at a finer grind than the original grinder) through another closed loop classifier, and then to a magnetic separator.

SUMMARY OF THE INVENTION

My invention saves energy by making it possible to utilize a relatively coarse grind and saves capital by minimizing the separation equipment used. I can accommodate a coarse grind because, contrary to the teachings of DeVaney and others, the coarse as well as fine iron particles are recovered as flotation froth concentrate while the locked or middlings particles remain in the underflow tailings and are returned to the ball mill. A size separation step is not needed to close the ball mill circuit. Locked particles cannot leave the ball mill circuit. I am able to pass to the flotation unit a material of relatively large size containing as much as 25–30% silica and still operate with great efficiency. My system can also recover coarse as well as fine hematite and carbonate particles which sometimes are present with magnetite.

My invention will be described with reference to the accompanying drawing, which is a diagrammatic representation of my circuit.

Referring to the drawing, the ore is ground in the ball mill to a size of about minus 48 mesh. It is then passed directly to a magnetic separator, where all the liberated, nonresponsive material is discarded. The magnetic concentrate, usually containing from 10% to 30% silica, is passed then to the flotation process, treated with an appropriate flotation agent in a conventional manner to create an iron concentrate in the froth, and the liberated iron particles separated as concentrate are used as the product while the tailings i.e. the unliberated locked middlings, are recirculated to the ball mill.

Conventional grinders, ball mills, magnetic separators and froth flotation units, as are familiar to the art, may be used in my invention.

It will be noted that there is no step in my process in which particles are separated by size alone. Thus, my process is able to produce a higher grade concentrate at a given fineness of grind, or a relatively coarse grind of concentrate of a grade which must be ground finer by conventional methods.

Anionic flotation agents are generally preferred; tall oil (a crude from of oleic acid) is an example of a satisfactory flotation agent. Cationic agents may also be used so long as they do not alter the desired result of delivering the high iron product to the froth.

My invention is not restricted to the above described illustrations and examples, but may be otherwise variously practiced within the scope of the following claims.

I claim:

1. Method of beneficiating iron ore comprising (a) grinding said iron ore to a size of minus 48 mesh, (b) passing the sized ore to a magnetic separator to separate a magnetic-responsive concentrate and remove a nonmagnetic portion therefrom, (c) passing the magnetic-responsive concentrate therefrom to a flotation process and separating the magnetic-responsive concentrate into a relatively high iron content concentrate in the froth and a relatively low iron tailing, (d) recovering the high iron content concentrate in the froth of the flotation process and (e) recycling the tailings of the flotation process to the grinding step.

2. Method of claim 1 in which the flotation reagent used in the flotation step is tall oil.

3. Method of claim 1 in which the magnetic-responsive concentrate passed to the flotation step contains from 10% to 30% silica.

* * * * *